United States Patent [19]

Rubesamen et al.

[11] 3,933,403

[45] Jan. 20, 1976

[54] ADAPTOR FOR FEEDING CURRENT TO ELECTRICAL CONTACT RAILS

[76] Inventors: Erich Rubesamen, Slavertrift 32; Karl Wehling, Liegnitzer Str. 9, both of 492 Lemgo, Germany

[22] Filed: Apr. 15, 1974

[21] Appl. No.: 461,179

[30] Foreign Application Priority Data

Apr. 26, 1973 Germany ..... 2320983

[52] U.S. Cl. ..... 339/22 R; 339/88 R

[51] Int. Cl.[2] ..... H01R 13/60; H01R 9/12

[58] Field of Search ..... 339/20, 21 R, 21 S, 22, 339/23, 24, 75 R, 75 M, 88 R, 184, 189, 190, 196 R, 206 R, 208, 207, 255 R, 188 C

[56] References Cited

UNITED STATES PATENTS

| | | | |
|---|---|---|---|
| 1,324,994 | 12/1919 | Benjamin | 339/206 R |
| 2,977,566 | 3/1961 | Neumann et al. | 339/20 |
| 3,531,758 | 9/1970 | Blumkin | 339/75 M |
| 3,639,885 | 2/1972 | Yoshiya | 339/21 R |
| 3,805,006 | 4/1974 | Clark | 339/225 R X |
| 3,848,715 | 11/1974 | Hesse | 339/21 R X |

FOREIGN PATENTS OR APPLICATIONS

| | | | |
|---|---|---|---|
| 1,520,959 | 3/1968 | France | 339/88 R |
| 35,498 | 11/1970 | Japan | 339/21 R |

*Primary Examiner*—Joseph H. McGlynn
*Assistant Examiner*—James W. Davie
*Attorney, Agent, or Firm*—Elliott I. Pollock

[57] ABSTRACT

An adaptor, for insertion into a power distribution rail to feed current to the rail, comprises a housing which is shaped and dimensioned to permit the adaptor to be inserted into the open bottom of the rail in a predetermined orientation relative to the rail and thereafter to be rotated through a limited angle between laterally spaced facing edges of opposing webs in the rail to turn supporting clips extending from the adaptor into support channels in the rail and to effect electrical contact between the adaptor and conductors carried by the rail. The adaptor housing comprises a pair of diametrically opposed cylindrical quadrants spaced from one another by a diametrical distance less than the distance between the laterally spaced facing edges of the rail web. The opposing ends of each cylindrical quadrant merge into a pair of flat planar sections which extend at substantially right angles to one another and which intersect the flat planar sections extending from the ends of the other cylindrical quadrant to define a pair of spaced substantially parallel edges located respectively between the opposing ends of the pair of cylindrical quadrants with the distance between the pair of edges being greater than the distance between the laterally spaced facing edges of the rail webs. The supporting clips extending from the adaptor are of elongated substantially rectangular configuration with the opposing elongated edges of each clip being disposed substantially parallel to a pair of the flat planar sections.

16 Claims, 6 Drawing Figures

ADAPTOR FOR FEEDING CURRENT TO ELECTRICAL CONTACT RAILS

BACKGROUND OF THE INVENTION

The present invention is concerned with a power distribution appparatus of the type comprising a power distribution rail associated with adaptors operative to feed current to the rail, and to pick up current from the rail. Such apparatuses are in themselves known in the prior art and are employed, for example, to permit lamps or other electrically energizable appliances to be located at any desired position along an elongated power distribution rail.

Power distribution systems of the general type discussed above conventionally employ a rail taking the form of an open-bottom channel-shaped metallic section each side of which includes a plurality of webs which are longitudinally spaced from one another to define elongated ducts along the opposing sides of the rail having elongated conductors supported therein in electrically insulated relation to the rail for electrical contact with the adaptor. The webs further define elongated support channels along the interior opposing sides of the rail which are spaced from the ducts and which are adapted to receive supporting clips comprising a portion of an adaptor, the support channels and clips being so positioned relative to one another that, when the clips engage the support channels contacts on the adaptor are properly located for electrical contact with the conductors supported by the rail. Each web on one side of the rail extends toward a corresponding web on one side of the rail extends toward a corresponding web on the other side of the rail, and the facing edges of each pair of corresponding webs are laterally spaced from one another to define an open region extending along the center line of the rail into which the adaptor may be inserted.

Various types of adaptors have been suggested heretofore for cooperation with a rail of the type described. In general, the prior art adaptors have been so designed that they must be inserted into the rail from one end of the rail and thereafter moved along the rail longitudinally to a desired position. This type of operation is inconvenient.

It is the primary object of the present invention to provide a different form of adaptor structure, capable of use to feed current to an electrical contact rail, which adaptor is so arranged that it may be inserted at any desired point within the rail and mated with only the correct rail conductors, and wherein the adaptor is far simpler in design, more easily locked in a correct operating position, and capable of being manufactured in smaller sizes than adaptors suggested heretofore.

SUMMARY OF THE INVENTION

The present invention is characterized by an adaptor structure which includes a support portion having supporting clips outstanding therefrom, with the exterior of said support portion being dimensioned to permit the adaptor to be inserted into the open region between the facing edges of the rail webs from the bottom of the rail and thereafter to be rotated through a limited angle to turn the adaptor supporting clips into the rail support channels thereby to effect electrical contact between the adaptor and the rail conductor. The adaptor support portion exterior comprises a pair of diametrically opposed cylindrical segments, preferably cylindrical quadrants, which are spaced from one another by a diametrical distance less than the distance between the laterally spaced facing edges of the webs in the rail, and this aspect of the structure, cooperating with polarizing clips which extend outwardly from the adaptor, permits the adaptor to be inserted into the rail and then turned in one direction only. To limit the angle through which the adaptor may be turned, once correctly inserted into the rails, the oposing ends of each cylindrical segment merge into a pair of flat planar sections with the flat planar section extending from each end of one the segments intersecting a flat planar section extending from one end of the other of said segments. The intersecting planar sections thus define a pair of spaced, substantially parallel edges on the support portion exterior which edges are located respectively between the opposing ends of the aforementioned pair of cylindrical segments, and the cylindrical segments and associated planar sections are so dimensioned that the distance between said pair of edges is greater than the distance between the laterally spaced facing edges of the webs in the rail therby limiting the angle through which the adaptor may be turned.

The aforementioned support portion of the adaptor may constitute a section of an adaptor housing which is integral with the supporting clips and which supports the electrical contacts which are to engage the rail conductors. In a preferred form of the invention, the adaptor housing is formed by two substantially symmetrical housing sections which complement one another, and a portion of the housing thus formed when the sections are juxtaposed includes a circular cylindrical section which may be associated with a clamping ring to retain the housing halves together. A screw can also be provided, extending between the housing halves, to assist in holding the halves together at a position spaced from the clamping ring. The housing halves can, if desired, be fabricated of insulating plastic material since the adaptor is subject only to very low mechanical stresses.

The adaptor is also provided with means, accessible from the bottom side of the adaptor, to rotate the adaptor through a desired angle. These means can take the form of a slot in the underside of the adaptor dimensioned to receive a screw driver or coin. The underside of the adaptor can, indeed, include a cover plate in which said slot is formed, with the cover plate being an integral portion of the aforementioned housing halves and being positioned for substantially flush engagement with the underside of the electrical contact rail. When such a cover plate is provided, the feeder will appear to be a homogeneous part of the contact rail, especially if the cover plate is designed in the form of a square or rectangular plate dimensioned to conform to the width of the contact rail.

The electrical contacts which form a portion of the adaptor preferably comprise L-shaped metal clips which are attached, within the housing, to appropriate cables, and which include portions which protrude radially outward of the housing through appropriate apertures formed in the housing. Compression springs are preferably provided in the housing, extending between a fixed portion of the housing and the L-shaped contacts, to urge the contacts radially outward thereby to achieve resilient engagement between the contacts and the rail conductors. The exterior of the housing supports a grounding clip which is also resilient in a radially outward direction. To assure that the apparatus can be installed in only one orientation relative to the rail, the supporting clips are of a polarizing nature and constitute, for example, a single radially extending clip on one side of the adaptor and a pair of axially spaced radially extending clips on the other side thereof.

The overall structure thus takes the form of a swiveling-type contact rail adaptor, in contrast to prior art feeder devices which must be inserted into the contact rail in a longitudinal direction only. When the adaptor of the present invention is to be employed as a feeder having lead wires which emerge above the contact rail, all that is necessary is to provide an aperture in the upper portion of the contact rail section, adjacent the point of installation, through which the lead wires or cable associated with the feeder can protrude. The feeder is then readily installed be being inserted at the proper point in the rail, by thereafter being turned through 90° with the angle of rotation being automatically defined and limited by the contoured configuration of the adaptor support portion, whereafter the adaptor is locked in its turned position by means of a set screw extending through the cover plate at the bottom of the adaptor housing.

BRIEF DESCRIPTION OF THE DRAWINGS

The foregoing objects, advantages, construction and operation of the present invention will become more readily apparent from the following description and accompanying drawings wherein.

DESCRIPTION OF THE PREFERRED EMBODIMENTS

Figure 1:
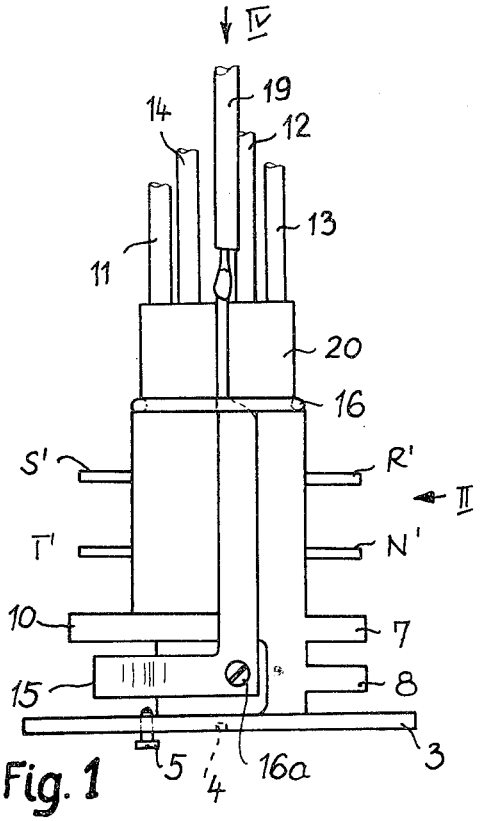
FIG. 1 is a side view of an adaptor constructed in accordance with the present invention.

The adaptor of the present invention comprises a housing taking the form of two housing halves 1 and 2 which are of symmetrical configuration. These housing halves can be fabricated of an insulating plastic material, include bottom portions which define a cover plate 3 having a slot 4 therein for the reception of a screw driver or coin to facilitate rotation of the adaptor, and which, at a location above the cover plate, are shaped to define radially extending supporting clips integral with the housing halves and constituting a pair of axially spaced, radially extending substantially rectangular clips 7 and 8 on one side of the housing, and a single radially extending, rectangularly shaped clip 10 on the other side of the housing.

Figure 2:
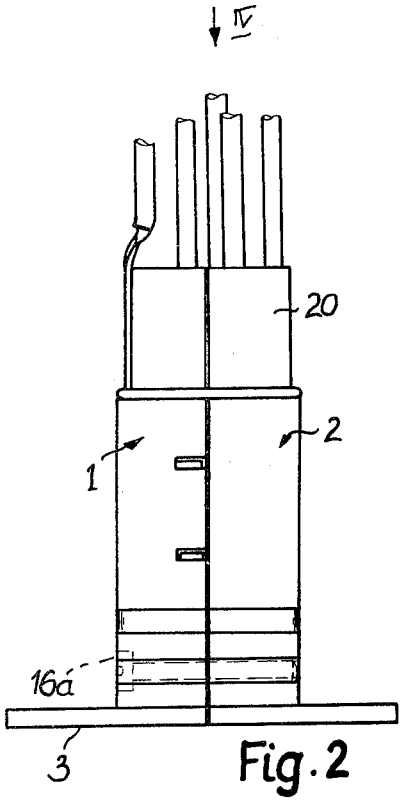
FIG. 2 is an end view of the adaptor as viewed in the direction indicated by arrow II in FIG. 1.
Figure 6:
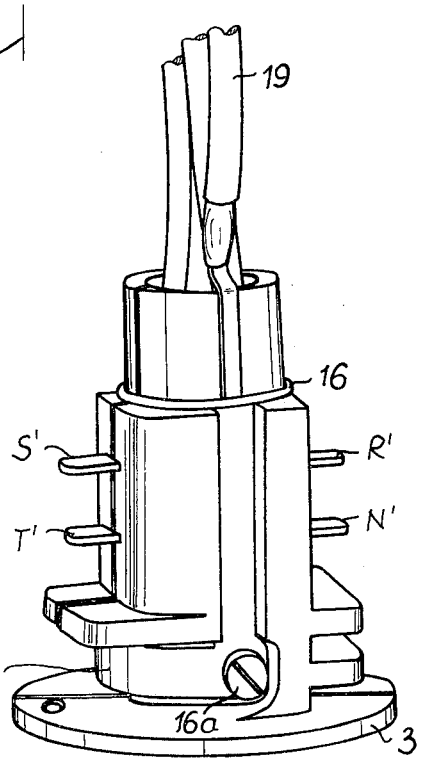
FIG. 6 is a perspective view of the adaptor of the present invention.

The two symmetrical housing halves are juxtaposed along an axial parting plane (see FIGS. 2, 4 and 6) to provice a complete housing. This housing includes a contoured support portion (which will be described in further detail subsequently) in the region above supporting clips 7, 8, 10 through which electrical contacts S′, T′, R′, and N′ protrude (see FIG. 6). The housing halves are differently shaped above this support portion to provide a region 20 of circular cylindrical configuration which may be surrounded by a clamping ring 16 which holds the housing halves together at a position near the top of the adaptor; and the assembly may further include a screw or bolt **16*a*** passing between the housing halves near the bottom of the assembly to assist in retaining the housing halves together.

A set screw 5 may be screwed into and through the cover plate 3 after installation and rotation of the apparatus to lock the adaptor in a desired turned position. The set screw 5 is positioned to engage a lower edge 6 of the contact rail (see FIG. 5) after the apparatus has been turned into its operating position, and functions to prevent the apparatus from being turned back to its initial insertion position.

Figure 5:
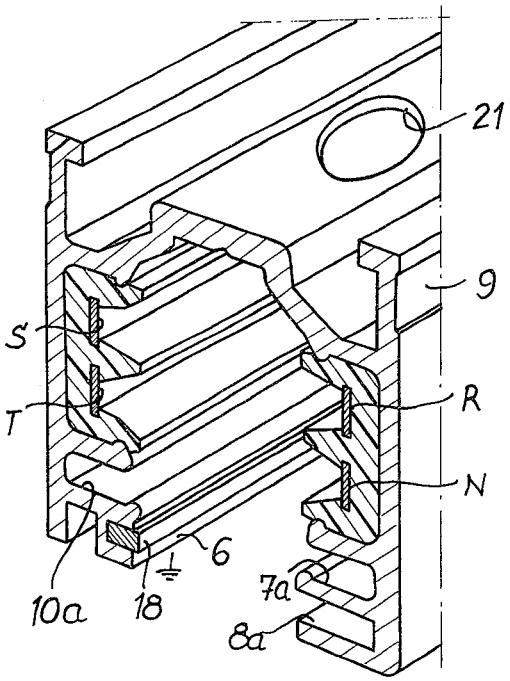
FIG. 5 is a perspective illustration of a known contact rail into which the adaptor of the present invention can be inserted.

The supporting clips 7 and 8 are intended to be turned into, and to engage, a pair of support channels **7*a* and 8*a* of the contact rail 9 (see FIG. 5). Similarly, the support clip 10 located on the other side of the adaptor is intended to be turned into and to engage support channel 10*a* of the rail. The supporting clips, and support portion of the adaptor to be described, are so dimensioned that the adaptor may be initially inserted through the open bottom of the channel with the support clips 7, 8, 10 extending longitudinally between the spaced facing edges of corresponding webs on the opposing sides of the rail 9, and the adaptor may then be turned in a single direction through an angle to cause the aforementioned supporting clips to be inserted into their corresponding support channels thereby simultaneously to effect electrical contact between the radially extending contacts S′, T′, R′, N′ of the adaptor and the corresponding insulator-supported conductors S, T, R, N which are supported in ducts within the rail (see FIG. 5). The exterior of the housing includes an arcuate grounding clip 15 which is supported on the housing by the aforementioned screw 16*a*, and which includes a portion spaced from the housing and free to flex at a position between supporting clips 10 and cover plate 3 (see FIGS. 1 and 6). This radially resilient grounding clip 15 is positioned to engage the ground conductor 18** forming a portion of the rail when the adaptor has been turned into its operating position.

Figure 3:
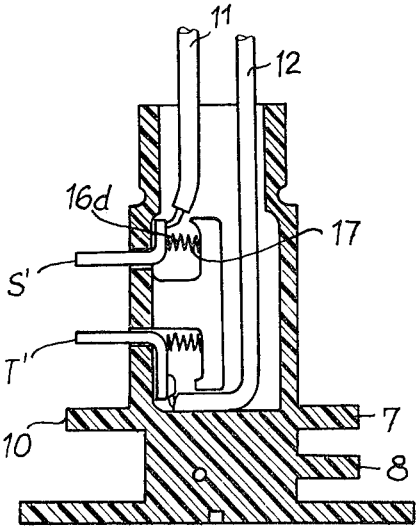
FIG. 3 is a cross sectional interior view of the right half of the housing shown in FIG. 2.

To achieve a resilient engagement between the adaptor contacts and the corresponding rail conductors, the electrical contacts S′, T′, R′, and N′ are preferably of L-shaped configuration as best shown in FIG. 3. One leg of each contact protrudes outwardly of the housing, through appropriate apertures formed therein, in a generally radial direction, and an additional portion of each contact located within the housing extends in a generally axial direction. These axially extending portions of the contacts are associated respectively, with compression springs **16*d* which extend between fixed surfaces 17 in the housing interior and the axially extending portions of the several contacts. The springs 16*d* thus urge the contacts in a radially outward direction. The axially extending portions of the four adaptor contacts are soldered, respectively, to cables 11, 12, 13 and 14 which extend outwardly of the housing through the top thereof. An additional cable 19 is connected to an axially extending portion of grounding clip 15 at a position near the top of the adaptor (see especially in FIGS. 1, 2 and 6) for passage, along with the other cables, through an aperture 21 in the top of the rail 9 adjacent the point of installation (see FIG. 5**).

Figure 4:
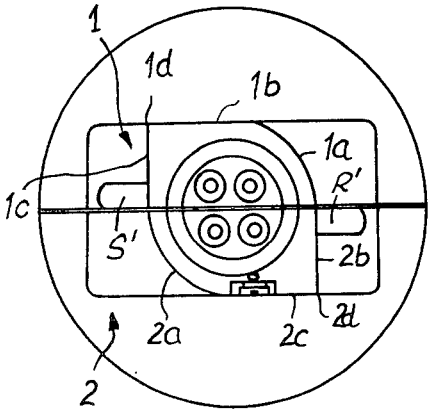
FIG. 4 is a plan view of the adaptor as viewed in the direction of the arrows IV in FIGS. 1 and 2.

The contoured configuration of the support portion of the housing, in the region of the radially extending adaptor contacts (see FIG. 6) will be most readily appreciated by reference to the plan view of FIG. 4. This particular portion of the housing comprises two circularly cylindrical segments 1*a* and 2*a*, each of which preferably comprises a cylindrical quadrant, which are positioned in diametrically opposed relation to one another. Because of the symmetrical configuration of the two housing halves 1, 2, one end of each cylindrical quadrant terminates at a position adjacent the parting line between the two housing halves. The opposing ends of the two cylindrical quadrants merge into a pair of flat planar sections respectively which are oriented at substantially right angles to one another. More particularly, as viewed in FIG. 4, the upper end of cylindrical quadrant 1*a* merges into a flat planar section 1*b*, and the lower end of quadrant 1*a* merges into a planar section 2*b* which is formed in the other housing half. Similarly, the lower end of quadrant 2*a* merges into a flat planar section 2*c*, and the upper end of quadrant 2*a* merges into flat planar section 1*c*. The flat planar sections associated with the two quadrants are oriented at right angles to one another and intersect one another to form two spaced axially extending, substantially parallel edges 1*d*, 2*d*, which are located respectively between the opposing ends of the cylindrical quadrants 1*a*, 2*a*.

The flat planar sections 1*b*, 2*c* are disposed in generally parallel relation to one another and are in alignment with or generally parallel to the opposing elongated edges of rectangular supporting clips 7, 8, 10. The distance between planar sections 1*c*, 2*b* along the parting line between the housings, and the distance between the flat planar sections 1*b*, 2*c* along the normal to said parting line, are equal to one another and equal to the diametrical distance between cylindrical segments 1*a*, 2*a*; and each of these distances is substantially equal to or slightly less than the distance between the facing edges of webs extending from opposing sides of rail 9. The distance between intersection edges 1*d*, 2*d* is, however, greater than the distance between the facing edges of opposing webs in rail 9.

Because of the configuration of the support section described above, the adaptor can be inserted through the bottom of rail 9 with planar sections 1*b*, 2*c* in alignment with elongated edges of the opposing webs in said rail, i.e., with supporting clips 7, 8, 10 extending in the direction of elongation of the rail 9. The cylindrical segments 1*a*, 2*a*, will then permit the adaptor to be rotated in a single direction relative to the rail webs, and such rotation can be effected only if the supporting clips 7, 8, 10 are so oriented that, upon rotation of the adaptor in the aforementioned single possible direction, supporting clip 10 will be turned into supporting channel 10*a* and supporting clips 7, 8 will be turned into supporting channels 7*a*, 8*a*. If the adaptor is inserted with the supporting clips in incorrect position relative to the rail, the adaptor cannot be turned at all and, instead, the adaptor must be removed, turned through 180°, and then reinserted into the bottom of the channel before it can be turned into its operative position. When the adaptor, properly oriented, is turned toward its operating position, the angle through which it may be turned is automatically defined by edges 1*d*, 2*d*, i.e., once those edges engage the opposing webs in rail 9, the adaptor cannot be turned further. The angle through which the adaptor may be turned is, by reason of the configuration described, substantially 90°, and once the adaptor has been turned through this angle it may be locked in place by advancing set screw 5 into engagement with inner edge 6 of the rail.

Having thus described our invention we claim:

1. An adaptor for insertion into a power distribution rail to feed current into the rail wherein the rail is of the type comprising an openbottomed channel-shaped metallic section having a top positioned opposite said open bottom and having a pair of spaced sides extending downwardly from said top, each of said rail sides including a plurality of webs which are longitudinally spaced from one another to define elongated ducts along the opposing interior sides of the rail having elongated conductors supported therein in electrically insulated relation to the rail for electrical contact with said adaptor and to further define elongated channels along the opposing sides of the rail spaced from the ducts and adapted to receive supporting clips comprising a portion of said adaptor, each web on one side of the rail extending toward a corresponding web on the other side of the rail with the facing edges of each pair of corresponding webs being laterally spaced from one another to define an open region extending along the vertical center line of the rail into which said adaptor may be inserted from the open bottom of said rail, the top of said rail having an aperture therein, said adaptor including a plurality of outwardly extending electrical contacts respectively connected to electrical conductors extending upwardly from said contacts for passage through said aperture in the top of said rail when said adaptor is inserted into the open bottom of said rail, said adaptor comprising a support portion having said supporting clips adjacent thereto, the exterior of said support portion being dimensioned to permit said adaptor to be inserted into the open region of the rail from the bottom of the rail below said aperture in the top of said rail in a predetermined orientation relative to the rail and being shaped to permit said inserted adaptor thereafter to be rotated through a limited angle between the laterally spaced facing edges of the pairs of corresponding webs to turn said supporting clips into the rail channels and to effect electrical contact between said adaptor contacts and the rail conductors, said support portion exterior comprising a pair of diametrically opposed cylindrical segments spaced from one another by a diametrical distance less than the distance between the laterally spaced facing edges of the webs in the rail, the opposing ends of each cylindrical segment merging into a pair of flat planar sections, the flat planar section extending from each end of one of said segments intersecting a flat planar section extending from one end of the other of said segments whereby said intersecting planar sections define a pair of spaced, substantially parallel edges located respectively between the opposing ends of said pair of cylindrical segments, the distance between said pair of edges being greater than the distance between the laterally spaced facing edges of the webs in the rail, and means adjacent the lowermost end of said adaptor for rotating said adaptor through said limited angle after said adaptor has been inserted into the bottom of said rail with its electrical conductors passing from said inserted adaptor to the exterior of the rail via said aperture in the top of said rail.

2. The adaptor of claim 1 wherein each of said cylindrical segments is substantially a cylindrical quadrant.

3. The adaptor of claim 2 wherein the pair of flat planar sections which extend from the opposing ends of each cylindrical quadrant are oriented at substantially right angles to one another.

4. The adaptor of claim 2 wherein said intersecting flat planar sections intersect one another at substantially right angles.

5. The adaptor of claim 1 wherein each of said supporting clips is of elongated, substantially rectangular configuration, the opposing elongated edges of each clip being substantially parallel to the pair of said flat planar sections which extend along the laterally spaced facing edges of said rail webs when said adaptor is initially inserted into the open bottom of said rail.

6. The adaptor of claim 2 wherein said adaptor comprises a housing having a section which constitutes said support portion, said housing consisting of two substantially symmetrical housing elements juxtaposed at a parting plane extending along the central axis of said adaptor, one of said cylindrical quadrants comprising an exterior portion of one of said housing elements and the other of said cylindrical quadrants comprising an exterior portion of the other of said housing elements.

7. The adaptor of claim 6 wherein one end of each of said cylindrical quadrants is located substantially at said parting plane.

8. The adaptor of claim 6 wherein said housing elements are fabricated of an insulating plastic material.

9. The adaptor of claim 6 wherein said housing elements include portions which, when juxtaposed, form a circularly cylindrical housing section, and a clamping ring disposed about said circularly cylindrical housing section for holding said housing elements together.

10. The adaptor of claim 9 including a threaded element for holding said housing elements together at a position spaced from said clamping ring.

11. The adaptor of claim 6 wherein said housing elements include portions which, when juxtaposed, form a cover plate at the bottom of said adaptor shaped and dimensioned to overlie the open bottom of the rail section in substantially flush engagement therewith.

12. The adaptor of claim 11 wherein said cover plate includes said means for rotating said adaptor from the bottom of the rail.

13. The adaptor of claim 12 wherein said means for rotating comprises a slot in said cover plate.

14. The adaptor of claim 1 wherein said plurality of electrical contacts extend in generally radial directions outwardly of said adaptor through apertures in said support portion for making electrical contact with the elongated conductors in the rail, and resilient means within the adaptor for urging each of said contacts in a radially outward direction.

15. The adaptor of claim 14 including a grounding contact adjacent said supporting clips, said grounding contact being resilient in a radially outward direction.

16. The adaptor of claim 1 wherein said adaptor includes a housing, said support portion comprising a shaped section of the housing exterior, said supporting clips being integral with said housing and constituting a single radially extending supporting clip on one side of the housing and a pair of radially extending axially spaced supporting clips on the opposite side of the housing.

* * * * *